United States Patent [19]

Cheynet

[11] 4,436,121

[45] Mar. 13, 1984

[54] PROCESS FOR MANUFACTURING AN ELASTIC OR NON-ELASTIC RIBBON

[75] Inventor: René Cheynet, St. Just-Malmont, France

[73] Assignee: Cheynet et ses fils, France

[21] Appl. No.: 230,026

[22] Filed: Jan. 30, 1981

[30] Foreign Application Priority Data

Feb. 1, 1980 [FR] France ..... 80 02511

[51] Int. Cl.[3] ..... D03D 47/00

[52] U.S. Cl. ..... 139/116; 139/117; 139/118; 139/432

[58] Field of Search ..... 139/116, 117, 118, 429, 139/431, 432

[56] References Cited

U.S. PATENT DOCUMENTS 3,104,683 9/1963 Weiner ..... 139/431

3,957,088 5/1976 Muller et al. ..... 139/117

FOREIGN PATENT DOCUMENTS 2036816 6/1980 United Kingdom ..... 139/118

*Primary Examiner*—Henry Jaudon

*Attorney, Agent, or Firm*—Eric P. Schellin

[57] ABSTRACT

A process for making a woven ribbon having stitched selvages on a ribbon loom by moving a single weft inserting member crosswise in two directions. The weft inserting member inserts a first auxiliary thread along each selvage and alternately drives a second auxiliary thread in the opposite direction outside the selvage.

7 Claims, 15 Drawing Figures

FIG.4
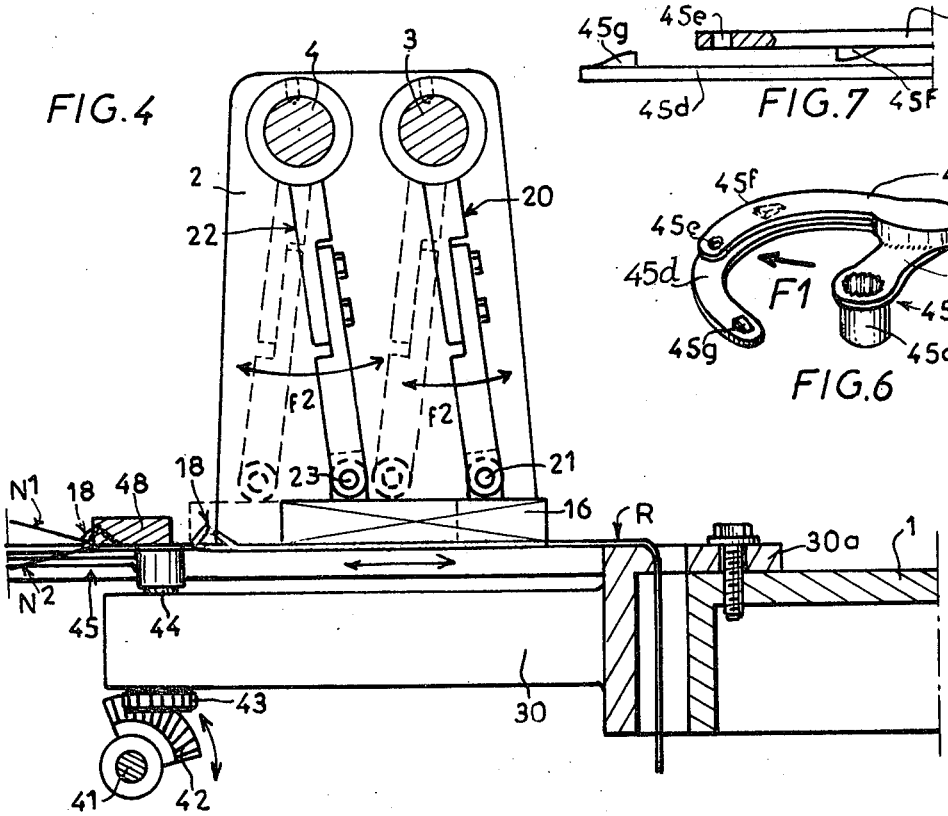
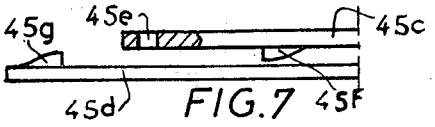
FIG.7
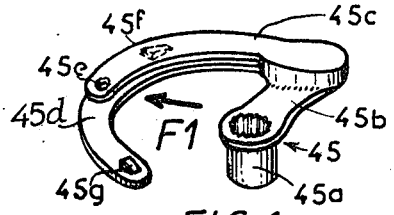
FIG.6
FIG.5
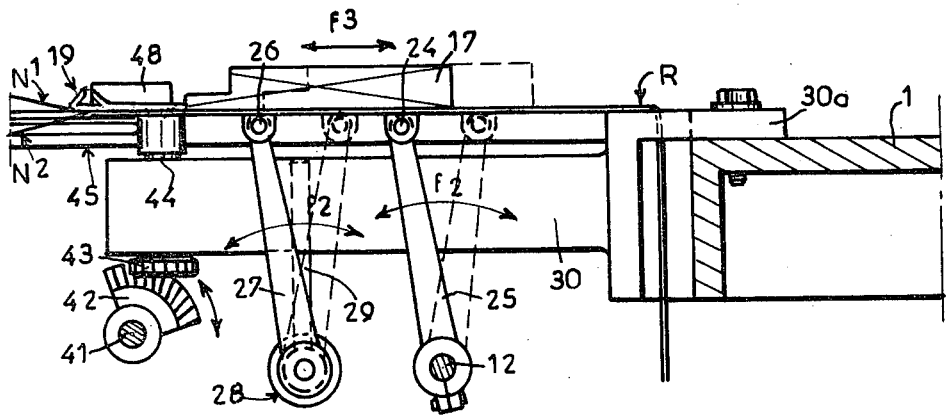

FIG.8
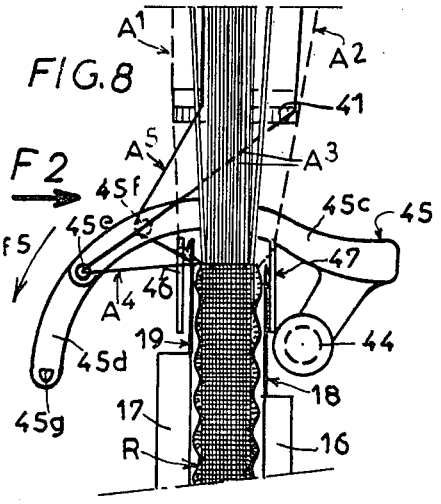
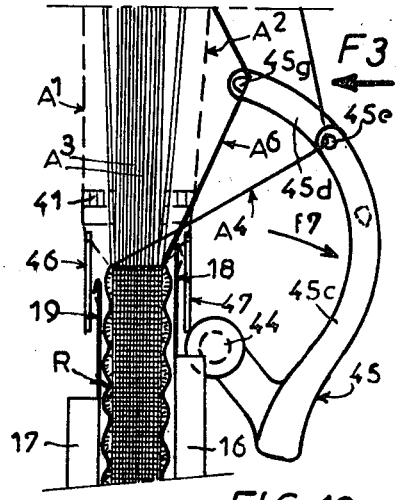
FIG.10
FIG.9
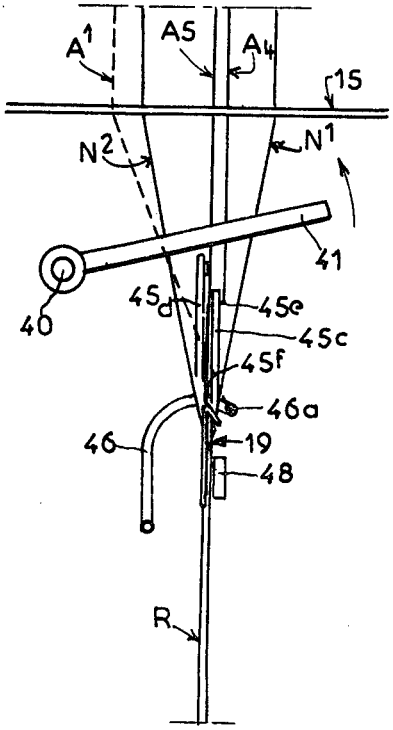
FIG.11
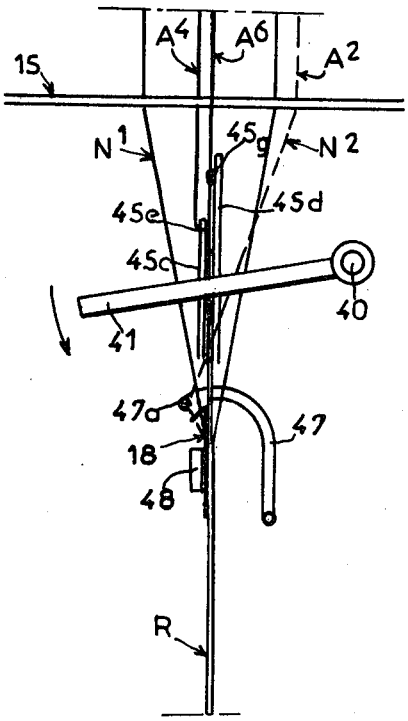

PROCESS FOR MANUFACTURING AN ELASTIC OR NON-ELASTIC RIBBON

The invention concerns a process for manufacturing an elastic or not ribbon with two meshed selvages, simple or crafted, the implementation means and the obtained products.

The subject of the invention is especially connected to the technical sectors of weaving, clothing, underclothes, ornaments, decorated items and ribbons.

According to the invention, one wanted to carry out, by weaving on looms that are so-called "tenterhooked" or with "sickles", mainly ribbons with two symmetrical meshed or not selvages with increased productivity and subsequently under economical circumstances, by working with restricted means, in order to obtain quality ribbons, of which the simple or crafted meshed selvages bear a regular look, without abnormal pulling on the chain threads, nor buckling of the selvages.

To this end, a first characteristic lies in the fact that one uses a single weft winder (or hook, or sickle) which one moves crosswise by driving each time and in both directions a single weft that one works alternately with a mobile needle along each selvage.

According to another characteristic of the process and the means of the invention, one uses a single weft winder (or hook, or "sickle"), that one moves crosswise by driving each time and in both directions one single weft, and one drives occassionally and alternately, with a weft winder, beyond one or the other edge of the cloth chain threads, with an unaligned chain thread inside the intermediate assembly, one activates alternately on one selvage and the other, the weft and occasionally the driven chain thread, with a mobile needle along each selvage, one frees the chain thread drawn to the outside and tied to the selvage when one drives crosswise in reverse the weft winder and the weft.

According to another characteristic, one directly and alternately nets the weft, and occasionally the driven chain thread, inside the hook of the needles that work along the selvages.

According to another characteristic, one uses at least one elastic or not supply thread on each selvage, that thread being driven crosswise in function of the weft thread and the chain thread pulled crosswise.

Those characteristics as well as others will be highlighted in the following description.

In order to establish the subject of the invention without limiting it, in the appended plates:

FIG. 4 is a cross cut view perceived according to line 4—4 of FIG. 1, especially depicting the terminal control, of the needle located on the rim of the right selvage of the ribbon.

FIG. 5 is a cross cut view perceived according to line 5—5 of FIG. 1, especially depicting the terminal control of the needle located on the rim of the left selvage of the ribbon.

FIG. 6 is a view in perspective depicting the weft winder according to the invention, in a non-restrictive implementation format.

FIG. 7 is a partial side view of the weft winder, perceived according to arrow F1 of FIG. 6, depicting the occasional hooking means of the chain threads.

FIG. 8 is a partial plane view depicting the forming of the left selvage of the ribbon with drive of a chain thread by the weft winder and the intake thread on the rim.

FIG. 9 is a corresponding side view, according to arrow F2 of FIG. 8.

FIG. 10 is a partial plane view depicting the forming of the right selvage of the ribbon with drive of a chain thread by the weft winder and the rim intake thread.

FIG. 11 is a corresponding side view, according to arrow F3 of FIG. 10.

In order to render more concrete that subject of the invention, it is now described in non-restrictive terms for implementation as illustrated in the plate figures.

The so-called "hook" or "sickle" loom depicted in FIGS. 1 through 5 basically includes a support 1, of which the lateral sides 1*a* each include a plate 2 designed to act as a bearing for upper shafts 3 and 4. Ultimately, according to the width of the loom, intermediate bearings can be arranged to avoid any bending.

Figure 1:
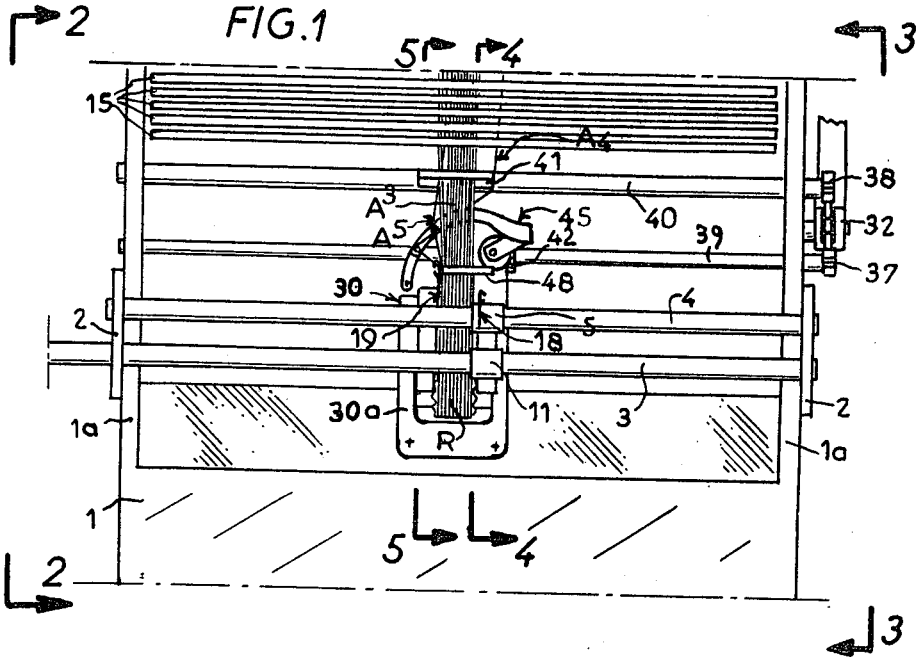
FIG. 1 is a schematic plane view that illustrates in part the main components of the weaving loom with hook or sickle, and especially the means of that loom as relates to the invention.
Figure 2:
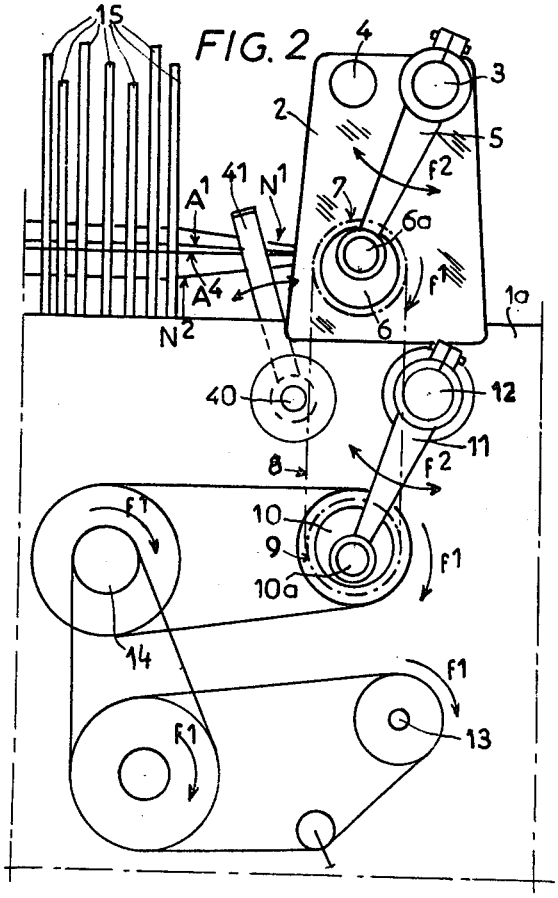
FIG. 2 shows in a side view perceived according to line 2—2 of FIG. 1, the main components of the loom and especially the control means of the needles.

As one can see especially in FIG. 2, on shaft 3, the crank of a rod 5 is wedged at the tip, the head of which is articulated upon the crank pin 6*a* of an excentric axis 6 carried by one of the plates 2. On said axis a sprocket wheel 7 or pulley is also wedged, connected by chain 8 or belt to another sprocket wheel 9 wedged onto another excentric axis 10 carried by a lateral side of the frame and the crank pin 10*a* of which accomodates the head of another push-rod 11 wedged into the other tip onto a lower shaft 12 crossing the loom. Shafts 3 and 12 on the one hand, and the excentric axes 6 and 10 on the other, represent a malleable parallelogram, and one should note that the crank pins 6*a*–10*a* are displaced by 180 degrees one in relation to the other so as to ensure alternated translation motions of the meshing selvage needles, of which the implementation detail is described later.

A motor shaft 13 transmits the rotation motion according to arrows f1 to the excentric axis 10 by way of a well-known kinematics, with, intermediately in 14, the equally conventional control of a cam box (not depicted) for moving in alternate translation motions the threading frame 15 carrying the row thread passage heddles, according to the weaving stage.

One understands that, when the excentric axis 10 turns (arrow f1), it drives the sprocket wheel 9, hence the sprocket wheel 7 and the excentric axis 6, which forces the push-rods 5 and 11 and the shafts 3 and 42 to oscillate (arrows f2). As one can see in FIGS. 4 and 5, the shafts 3 and 12 transmit their oscillations f2 to connecting organs with blocks 16–17 carrying the needles 18–19. To clarify the drawings, we illustrated only the control mechanisms for implementing a ribbon, since those mechanisms are multiplied if the loom must manufacture several ribbons.

In a detailed manner, a small rod 20 is wedged on shaft 3 in two sections, the other tip of which is articulated in 21 behind the block 16, while another small rod 22 in two sections, wedged onto shaft 4 parallel to shaft 3, is articulated in 23 in front of block 16. That flexible parallelogram assembly makes it possible to ensure alternate translation motions (arrows f3) of block 16 carrying needle 18 which is to be used for stitching the right selvage (FIG. 4) of ribbon R which runs between that needle and the left selvage stitching needle (FIG. 5), of which the carrier unit 17 is connected in an articulated fashion, on the one hand, to the rear in 24 to a small rod 25 wedged onto shaft 12, and, on the other hand, to the front in 26 to a small rod 27 articulated onto a support 28 in order to constitute another flexible parallelogram. Said support is carried by a stem 29 attached to a cross piece 30, the sole of which 30*a* is affixed to the frame 1.

Because of the 180 degree displacement of the crank pin 6*a*–10*a*, we perceive that the needles 18–19 move alternately, or when needle 18 is in optimum rear position (FIG. 4), the needle 19 is in optimum front position (FIG. 5) or inversely (broken lines).

Figure 3:
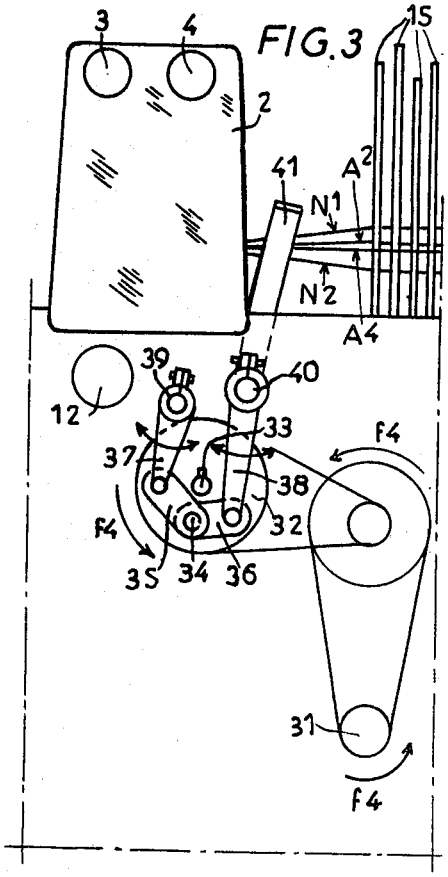
FIG. 3 shows in a side view perceived according to line 3—3 of FIG. 1, the control means of the comb and the weft winder.
Figure 12:
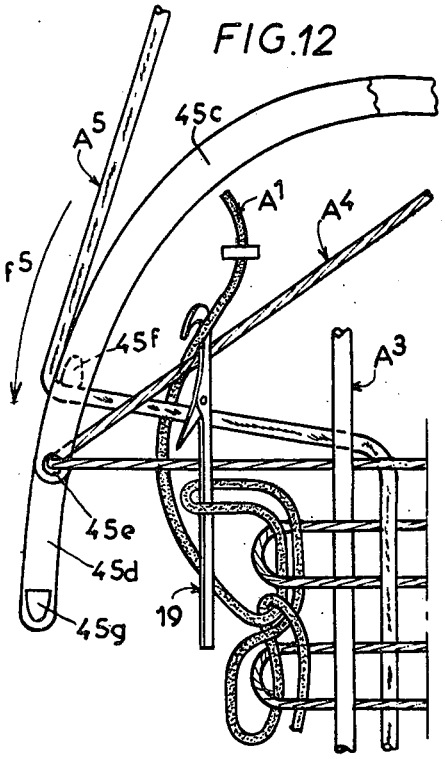
FIG. 12 is a partial plane view at a greater scale, depicting the drive of a chain thread by the weft winder when the latter is substantially at the end of the one-way run.

One also sees especially in FIGS. 2 and 3, a motor shaft 31 transmitting by an appropriate kinematics, its rotation motion (arrow f4) to a pulley 32 wedged onto shaft 33 carried by the frame, and on which a cfank pin 34 controls two small rods 35–36 connected in an articulated manner to push rods 37–38 wedged onto shafts 39–40.

Shaft 40 crosses the loom and carries a reed 41 (as many reeds as there are ribbons to implement) for sorting and consolidating weft threads, while the shaft 39 carries a sprocket sector 42 working with a pinion 43 wedged at the tip of an axis 44 carried by the cross piece 30 (FIGS. 4 and 5).

On the axis 44 the weft winder or sickle 45 is wedged, since there are also as many weft winders and organs for their control (pinions 43, sprocket sector 42), as there are ribbons to implement.

The single weft winder 45 especially illustrated in FIGS. 6 and 7, includes an angular linkage pivot 45*a* with axis 44, a deflection arm 45*b* at the tip of which, according to approximately superimposed curved lines around the pivot, two branches 45*c*–45*d* extend. The upper branch 45*c* displays at the free end an eyelet 45*e* for passage of the weft thread, and, between the arm 45*b* and the said end, the branch 45*c* carries under it (on the side of the lower branch) a protrusion 45*f*, directly formed or set-in, and correctly directed to retain and drive under the operating conditions described later, a row thread. The lower branch 45*d* which is longer than the branch 45*c*, displays on the tip a protrusion 45*q* similar to the protrusion 45*f* but located above it (on the side of the upper branch) and also designed to retain and drive occasionally a row thread.

By referring more particularly to FIGS. 8 through 15, we now describe the manufacturing process for a ribbon R with two stitched symmetrical or not selvages, with the means described hereinafter.

In all that follows, we describe the forming of right and left selvages with an intake thread A1–A2 allowing to monitor the scalloped selvages, since those selvages can be implemented without intake thread.

Those right and left intake threads (illustrated in broken lines in the figures) can be or not elastic threads, or made of at least one elastic strip and at least a non elastic strip assembled by lapping, especially elastic thread or strip lapped with the non elastic thread or strip.

The elastic or not row threads A3 which are released by donor systems, are distributed in conventional manner into two fleeces N1–N2 (FIGS. 9 and 11) with the heddles from the threading frames 15 and guided in the reed 41 while a weft thread A4 located on the edge of the reed (at its right) is connected to the eyelet 45*e* of the single weft winder 45.

The intake threads A1–A2 are also located to the right and to the left of the reed and pass inside the eyelets 46*a*–47*a* of levers 46–47 articulated on each side of the ribbon, substantially in front of the small support bar 48 on the woven ribbon, or approximately at level with the hooks of the needles 18–19 when they are in optimum forward position (FIGS. 9 and 11).

During a number of weft turns, which depends on the type of scallops to be implemented, the ribbon is woven in the standard way, or with meshing or knotting of intake threads A1–A2 if applicable, with weft A4 on each side of the ribbon, combined with the crossing of fleeces N1–N2 of the chain threads A3, and the needles 18–19.

Figure 13:
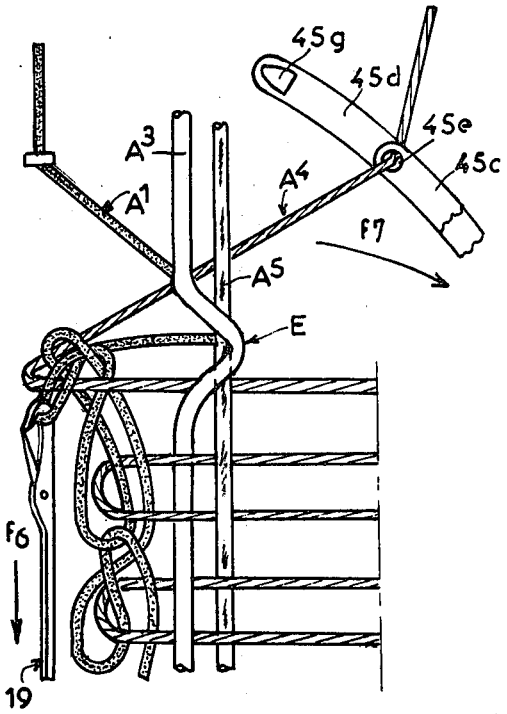
FIG. 13 is a view corresponding to FIG. 12, in the following return phase of the weft winder and meshing of the left selvage, with a rim intake thread.
Figure 14:
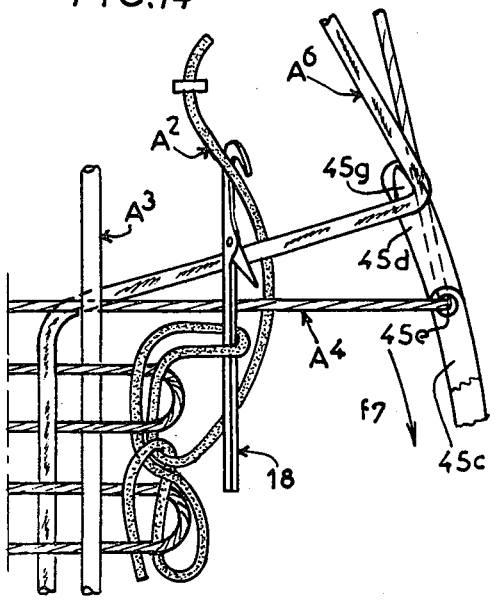
FIG. 14 is a partial plane view at a greater scale, depicting the drive of a chain thread by the weft winder when the latter is on its one-way run.
Figure 15:
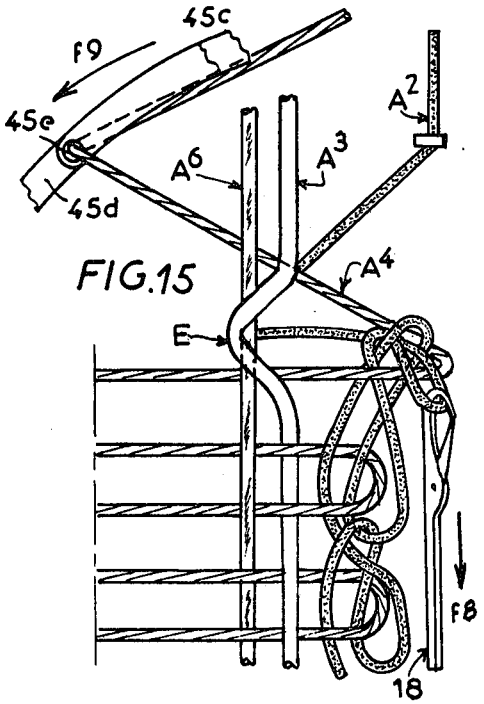
FIG. 15 is a view corresponding to FIG. 14, in the following return phase of the weft winder and meshing of the right selvage, with rim intake thread.

After that selected number of weft turns, one of the chain threads located close to the left border (the second in the example illustrated in FIGS. 12 and 13) is maintained substantially in the middle of the "tread" by the control of its threading frame (between the two fleeces N1–N2) to be affixed and driven by the protrusion 45*f* located under branch 45*c* of weft winder 45 moving along arrow f5 (FIG. 12), so that this chain thread A5 can follow the same itinerary as the weft A4 and can contribute to the selvage meshing or tying, in function of the intake thread A1 brought in by the lever 46, the weft A4 and the needle 19 previously in forward optimum position then reversing (arrow f6), when the weft winder 45 returns to the right of the ribbon (arrow f6) by releasing the chain thread A5 (FIG. 13).

Hence one understands that, the chain thread A5 which was drawn beyond the edge, when released by the weft winder, resumes substantially, because of elasticity, its initial posture by drawing towards it the chain thread(s) A3 located between it and the edge, which triggers in that area E (FIG. 13) a withdrawal of the ribbon in relation to the edge. That withdrawal is all the more significant since the number of chain threads A3 located between the thread A5 and the edge is significant or the distance between the edge and said thread A5, which provides depth to the festoon.

The right selvage festoon can be implemented in the same weft turn or after a certain amount of weft turns, in the same fashion as for the left selvage.

Indeed, when the weft winder returns to the right of the ribbon (arrow f7, FIGS. 10 and 14), a chain thread A6 (the second in the illustrated example) is kept fairly much in the middle of the "tread" to be hooked and driven by the protrusion 45*q* of branch 45*d* of the weft winder, following the weft thread A4. With needle 18 in optimum forward position then returning (f8 arrow), and the intake thread A2 brought by its lever 47 at the level of the weft and the chain thread A6 released by the weft winder returning to the left of the ribbon (arrow f9), meshing takes place in the same way as for the left festoon (FIGS. 10, 14 and 15), and the released chain thread A6 creates the bottom of the festoon by pulling the chain threads A3 located between it and the edge.

Obviously, the two selvages can be identical or crafted differently for instance the festoon can be equal in size and in appearance or different in appearance, by the fact that there is or is not intake thread or by the distance between the edge of the ribbon and the chain thread driven by the weft winder, or the number of chain threads located between the edge and the thread driven by the weft winder.

It should be noted that the driving points (protrusions **45*f*–45*q*) of the chain threads A5–A6, are defined on the weft winder branches, in relation to its rotation axis lateral to the ribbon, which leads to extending the lower branch, so that the chain threads A5–A6** are not excessively driven beyond the edge, which would trigger risks of rupture or permanent distortion of said threads, but also for pulling said chain threads sufficiently beyond the ribbon along its width.

One underscores the significance and the interest of the combination: a single weft winder, a single weft thread and two needles.

Hence, the means are simple in their design, assembly and operation. More efficient manufacturing, and the products carry an interesting cost price. Use of the two needles prevents sliding and tightening of the chain threads which are near the selvages, by rubbing action of the weft during retrieval of the weft winder. The needle that connects on each side the weft and the selvage prevents an inadequate display resulting from uneven edges.

Furthermore, the single weft winder has less cumbersomeness to impose on the looms, so that one can loom ribbons with two meshed selvages, along a relatively significant width.

The invention in no way is restricted to any of its implementation modes nor to the implementation modes of its various components which are mentioned in particular; on the contrary, it encompasses all its variations.

I claim:

1. A process for making a woven ribbon with two stitched selvages on a ribbon loom by moving a single weft inserting member crosswise in two directions, the weft inserting member driving a single weft thread in both directions, the weft inserting member inserting a first auxiliary thread in one direction to a position outside one selvage edge and alternately driving a second auxiliary thread in the opposite direction to a position outside the opposite selvage edge, the weft inserting member engaging each of the auxiliary threads during one direction of movement and being free of such engagement during movement in the opposite direction, tying each freed auxiliary thread to the respective selvage along with the weft thread when the direction of the weft inserting member is reversed.

2. The process of claim 1, wherein intake threads are provided along each selvage edge, stitching the weft thread, the auxiliary threads and the intake threads by means of phase operating needles positioned along side the selvage edges.

3. The process of claim 2, wherein the weft inserting member forms a loop in the weft thread and the respective auxiliary thread along each selvage edge at the end of each direction of movement, said needles drawing the intake thread through each loop during the stitching thereof.

4. The process of claim 3 wherein each of the intake threads comprises at least one elastic strip and at least one nonelastic strip, the strips being assembled by lapping.

5. The process of claim 4 wherein an elastic strip is lapped with a nonelastic strip.

6. A weaving loom including a single reciprocating weft inserting member which comprises two branches of uneven lengths, the shorter branch being fitted at its tip with a weft engaging eye to carry the weft thread in both directions of movement thereof, said shorter branch having located on one side thereof a protrusion operative to engage and carry in one direction of movement an auxiliary thread, the longer branch having on open side thereof a protrusion operative direction of movement of said member another auxiliary thread means in the other direction for at least one auxiliary thread.

7. The apparatus of claim 6 wherein an eccentric axis is connected with a push-rod to a control shaft for a needle located on the edge of a selvage of a ribbon and is borne by a bloc connected to the shaft by a flexible parallelogram system, wherein a second needle located in the opposite edge of the selvage of the ribbon is controlled by the eccentric axis by a sprocket-wheel chain transmission and by a second eccentric axis connected by a push-rod to a control shaft of a needle bearing the second eccentric axis connected to the shaft and to a parallel shaft borne by components of the frame of the ribbon loom by push-rods comprising a flexible parallelogram; crank pins of the eccentric axis being spaced by 180 degrees to allow the needles to exert inverse alternate translation motions.

* * * * *